US011339615B2

(12) United States Patent
Holck

(10) Patent No.: US 11,339,615 B2
(45) Date of Patent: May 24, 2022

(54) DRILLING RIG HOISTING SYSTEM

(71) Applicant: MAERSK DRILLING A/S, Kgs. Lyngby (DK)

(72) Inventor: Jesper Holck, Hellerup (DK)

(73) Assignee: MAERSK DRILLING A/S, Kgs. Lyngby (DK)

( * ) Notice: Subject to any disclaimer, the term of this patent is extended or adjusted under 35 U.S.C. 154(b) by 67 days.

(21) Appl. No.: 16/486,656

(22) PCT Filed: Feb. 19, 2018

(86) PCT No.: PCT/EP2018/054017
§ 371 (c)(1),
(2) Date: Aug. 16, 2019

(87) PCT Pub. No.: WO2018/150022
PCT Pub. Date: Aug. 23, 2018

(65) Prior Publication Data

US 2021/0301601 A1 Sep. 30, 2021

(51) Int. Cl.

| | |
|---|---|
| ***E21B 19/06*** | (2006.01) |
| ***B66D 3/08*** | (2006.01) |
| ***E21B 19/00*** | (2006.01) |

(52) U.S. Cl.
CPC ..... *E21B 19/06* (2013.01); *B66D 3/08* (2013.01); *E21B 19/006* (2013.01)

(58) Field of Classification Search
CPC ..... E21B 19/06; E21B 19/006; B66D 3/08
See application file for complete search history.

(56) References Cited

U.S. PATENT DOCUMENTS

| | | | |
|---|---|---|---|
| 1,436,608 | A | 11/1922 | Rodier |
| 4,721,286 | A | 1/1988 | Hey et al. |

(Continued)

FOREIGN PATENT DOCUMENTS

| | | | |
|---|---|---|---|
| DE | 2403977 | A1 | 8/1975 |
| DE | 2849322 | A1 | 7/1979 |

(Continued)

OTHER PUBLICATIONS

Danish Patent Application No. PA 2017 00116, Danish Search Report dated Sep. 14, 2017; 4 pgs.

(Continued)

*Primary Examiner* — James G Sayre
(74) *Attorney, Agent, or Firm* — Lathrop GPM LLP

(57) ABSTRACT

A hoisting system for a drilling rig, which has a crown block for attaching to a derrick, the crown block comprising a plurality of sheaves; a travelling block suspended from the crown block via a hoisting cable, the travelling block comprising a plurality of sheaves and being connectable with a payload, the travelling block being arranged to move along a workpath; the hoisting system further comprising: a floating block comprising a plurality of sheaves reeved on the hoisting cable; wherein the floating block is configured to move between: a first arrangement in which the floating block is fixed relative to the crown block; and a second arrangement in which the floating block is fixed relative to the travelling block; wherein the hoisting system is arranged such that, when the floating block is in one of the first or second arrangement, the sheaves of the floating block overlap a sheave of the crown block or travelling block in a direction of the workpath.

21 Claims, 11 Drawing Sheets

(56) References Cited

U.S. PATENT DOCUMENTS

| | | | | |
|---|---|---|---|---|
| 6,595,494 | B1 * | 7/2003 | Roodenburg | B66C 13/02 254/277 |
| 6,901,998 | B1 | 6/2005 | Roodenburg et al. | |
| 6,926,103 | B1 * | 8/2005 | Roodenburg | B66D 3/043 175/171 |
| 6,926,259 | B1 | 8/2005 | Roodenburg et al. | |
| 8,905,381 | B2 * | 12/2014 | Slob | B66D 3/043 254/273 |

FOREIGN PATENT DOCUMENTS

| | | | | |
|---|---|---|---|---|
| DE | 37 36 287 | A1 | 9/1988 | |
| EP | 3715580 | A1 * | 9/2020 | E21B 19/02 |
| FR | 2 228 024 | A1 | 11/1974 | |
| WO | WO 92/14028 | A2 | 8/1992 | |
| WO | WO-9214028 | A2 * | 8/1992 | B66D 3/06 |

OTHER PUBLICATIONS

International Patent Application No. PCT/EP2018/054017, International Search Report and Written Opinion dated May 24, 2018, 10 pgs.

* cited by examiner

DRILLING RIG HOISTING SYSTEM

CROSS-REFERENCE TO RELATED APPLICATIONS

This application is a 35 U.S.C. § 371 filing of International Application No. PCT/EP2018/054017 filed Feb. 19, 2018, which claims the benefit of priority to Danish Patent Application No. PA 2017 00116 filed Feb. 17, 2017, each of which is incorporated herein by reference in its entirety.

FIELD

The present disclosure relates to a drilling rig hoisting system, for example for use on any vessel or infrastructure used to perform operations associated with wellbores.

BACKGROUND

Hoisting systems are used in multiple applications for handling payloads, such as on offshore vessels, platforms, rigs and the like associated with the oil and gas industry. For example, hoisting systems are used on drilling rigs for supporting drilling operations, for example for supporting the upper end of a drill string. Hoisting systems may also support other lifting operations, including deployment/retrieval of equipment, such as in-well equipment (e.g., casing or liner strings, completion equipment, and the like) and subsea equipment (e.g., Blow Out Preventers (BOPs), Xmas trees and the like).

The term payload refers to all of the items suspended from the travelling block. A payload map be considered to include a string of components which extend from the hoisting system into the wellbore, connected to a top drive, which is used to apply torque to the string of components located below the top drive. The various components which may be suspended from the top drive may include, for example, drill bits and a plurality of tubing elements. Collectively, the components connected to the top drive are referred to herein as the net-payload.

The lifting capacity of a hoisting system is a significant consideration, and in many cases is a limiting factor in the ability to exploit particular drilling rigs. This issue is becoming more prominent as the offshore oil and gas industry seeks to operate in deeper water and under increasing well pressures (e.g., up to and beyond 20 kpsi), which necessitates the use of heavier equipment and the like.

In known pulley based hoisting systems additional load capacity can be gained by utilising additional pulley sheaves. However, while an increase in load capacity can be achieved, hoisting speed is compromised and wire wear is exacerbated, which is not desired, especially where a single hoisting system may be required to handle a full range of loads, as well as heave compensating such loads during short or extended periods of time. In some instances, for example, a hoisting system may be designed and deployed in accordance with a maximum anticipated payload, with a corresponding limited hoisting speed. This limited hoisting speed may therefore be present for all payloads, which for many lifting operations may be below the maximum design load.

When operating offshore, for example on offshore rigs, tidal and wave motion can make it difficult to maintain constant lifting speeds or forces. This can be especially problematic when the system is operating in a locked to bottom mode, in which the string is physically connected to a component on the seabed.

SUMMARY

An aspect or example relates to a hoisting system for a drilling rig, the hoisting system may comprise:

- a crown block for attaching to a derrick; the crown block may comprise a sheave or a plurality of sheaves;
- a travelling block suspended from the crown block via a hoisting cable; the travelling block may comprise a sheave or a plurality of sheaves and may be connectable with a payload. The travelling block may be arranged to move along a workpath.

The hoisting system may further comprise:

- a floating block comprising a sheave or a plurality of sheaves reeved on the hoisting cable.
  - The floating block may be configured to move between: a first arrangement in which the floating block or a part thereof is fixed, constrained or restrained relative to the crown block or the sheaves thereof; and a second arrangement in which the floating block or a part thereof is fixed, constrained or restrained relative to the travelling block or the sheaves thereof.
  - The hoisting system may be arranged such that, when the floating block is in one of the first or second arrangement, the sheaves of the floating block overlap a sheave of the crown block or travelling block in a direction of the workpath.

A hoisting system is used in a number of different fields and may be referred to herein as a hoisting system, hoisting system or simply a hoisting. In particular, hoisting systems are used in the oil and gas technology fields for manipulating a payload suspended above a wellbore. The hoisting system may be used to lift and lower a payload along a workpath. The workpath describes the space through which a payload may move when moving between the minimum and maximum lift of the hoisting system. The term "direction of the worthpath" is the direction along which the payload moves between the minimum and maximum lift positions of the hoisting system. The direction of the workpath may, depending on the arrangement of the hoisting system, be vertical.

The hoisting may comprise a crown block which is fixed relative to a derrick. The derrick may be a support arrangement configured to support the hoisting over a wellbore. The crown block may comprise a plurality of sheaves positioned over the opening of a wellbore. The crown block may also comprise a series of braces, attachment members, or suspending or locating devices to fix and locate the crown block relative to the derrick.

The sheaves of the crown block may be stationary with respect to the derrick. A first pair, or more, of the sheaves of the crown block may be substantially parallel and coaxial—i.e. they are totally overlapping in a direction of the workpath, essentially forming a stack or row of sheaves.

The precise orientation and arrangement of sheaves of the crown block may be determined by the location of the work path and the spooling of the hoisting cable. Depending on the number and arrangement of the other components of the hoisting system, the sheaves of the crown block may not be coaxial or parallel, but may instead be separated into multiple groups of sheaves. Each group of sheaves may comprise a plurality of sheaves arranged parallel and coaxial. A second pair, or more, of the sheaves of the crown block may be skewed, offset or displaced relative to the first pair or more of sheaves. The groups of sheaves may be arranged obliquely to each other when viewed along the direction of the workpath, such that the axis of rotation of each group of sheaves forms an acute angle. The groups of sheaves may be separated and arranged such that a further component or group of sheaves can be arranged therebetween.

The travelling block may comprise a plurality of sheaves. The travelling block may be suspended from the crown block. The travelling block may comprise attachment means or devices, or connectors, such that a payload (for example comprising a top drive and a net payload) can be attached to travelling block. The travelling block may be raised or lowered along the workpath by operation of the hoisting system. The travelling block may move vertically up and down, towards and away from the crown block.

The crown block and travelling block may be associated with each other by means of a hoisting cable. A hoisting cable may be alternately threaded, or reeved, around the sheaves of the crown block and travelling block such that movement of the hoisting cable results in movement of the travelling block towards the crown block. The lifting ratio (i.e. the ratio between the winch's maximum load capability to the maximum load that can be lifted by the hoisting system) is determined by the number of utilised pulley pairs between the stationary components and the payload.

Movement of the hoisting cable may be facilitated by a winch associated with a first end of the hoisting cable. The second end of the hoisting cable may be associated with an anchor, or with a second winch. Activation of the one winch, or of the two winches, to draw the hoisting cable in, will result in the travelling block moving towards the crown block, thus raising the payload.

As discussed above, it is desirable to have a hoisting system with a large maximum load capacity, but also a maximum hoisting (lifting) speed which is higher than that associated with the maximum load capacity.

The provision of a floating block may allow a single hoisting system to have two different lifting ratios (i.e. maximum lifting weight and speed capabilities). In essence, the floating block may allow the hoisting system to have different gears, whereby in a first gear (e.g. in a first arrangement) a certain number of pulley pairs are utilised in the hoisting system and in a second gear (e.g. a second arrangement) a different number of pulley pairs are utilised in the hoisting system. This may be achieved by altering the number of pulley pairs between the fixed component (e.g. a crown block) and the moving payload component (e.g. the travelling block) when moving being the first and second gear/arrangement.

This may be implemented by the floating block having two distinct configurations—a first arrangement in which it is fixed relative to the crown block and a second arrangement in which it is fixed relative to the travelling block, and hence travels along the workpath with the travelling block. In the first arrangement, the hoisting system may comprise a first number of pulley pairs between the combination of the crown block and the travelling block, and the travelling block, providing a first lift ratio. In the second arrangement, the hoisting system may comprise a second number of pulley pairs between the crown and the combination of the floating block and the travelling block, providing a second lift ratio.

Which of the first and second arrangement provides the maximum lifting force (i.e. more pulley pairs) and which provides the maximum lifting speed (i.e. fewer pulley pairs) depends on how the hoisting cable is reeved onto the floating block. If the floating block is reeved onto the hoisting cable in a similar arrangement to how the travelling block is reeved onto the hoisting cable—i.e. suspended from the crown block, whereby the sheaves of the floating block alternate with sheaves of the crown block on the hoisting cable—pulley pairs may be formed between the crown block and the floating block. Here, in the first arrangement, where the floating block is fixed relative to the crown block will provide a lower maximum lifting force but a higher maximum lifting speed. This is because there will be fewer pulley pairs involved in the lifting of the travelling block, since pulley pairs formed between the crown block and the floating block are not active during use (since the floating block is fixed relative to the crown block).

The second arrangement will provide a higher load capacity (maximum lifting force), but a lower maximum hoisting speed. This is because there will be more active pulley pairs involved in the lifting of the travelling block, as the pulley pairs between the crown block and the floating block are now active during use (since the floating block is fixed relative to the travelling block), in addition to the pulley pairs between the crown block and the travelling block.

If the floating block is reeved onto the hoisting cable in a similar manner to how the crown block is reeved onto the hoisting cable—i.e. part of the travelling block is suspended from the floating block, whereby the sheaves of the floating block alternate with sheaves of the travelling block on the hoisting cable—pulley pairs may be formed between the floating block and the travelling block. Here, in the second arrangement, where the floating block is fixed relative to the travelling block will provide a lower maximum lifting force but a higher maximum lifting speed, since the pulley pairs formed between the floating block and the travelling block are not active during use and so fewer pulley pairs are active during use.

In the first arrangement, the pulley pairs formed between the floating block and the travelling block are active during use, thus the total number of active pulley pairs is higher, and the maximum load capacity is higher, but the maximum hoisting speed is lower.

The sheaves of the floating block may overlap a sheave of the crown block or travelling block in a direction of the workpath when the floating block is in one of the first or second arrangement. The overlap may be a partial overlap.

An overlap in the direction of the workpath refers to an overlapping of a sheave of the floating block with a sheave of the crown or travelling block when viewed from the side of the hoisting system, e.g. from the left and right hand sides of FIG. 1.

The distance in the workpath direction between an axis of rotation of a sheave, or all of the sheaves, of the floating block and an axis of rotation of a sheave, or all of the sheaves, of the crown block or travelling block may be less than a first distance when the floating block is in one of the first or second arrangements. The first distance may be equal to the combined radiuses of the sheave of the travelling block and the sheave of the crown block or travelling block. The first distance may be equal to the radius of one of the sheave of the floating block or the crown block or travelling block. The distance between the axes of rotation may be zero.

Such an arrangement, in which an overlap is provided between the floating block and one of the crown block and the travelling block reduces the impact of the geared system on the length of the workpath. That is, given a fixed distance between the crown block and the travelling block, the inclusion of a travelling block does not reduce the maximum length of the workpath by the size of the floating block, as would otherwise be the case.

If the floating block is not arranged such that it overlaps a sheath of at least one of the crown block and the travelling block, it will take up space in the workpath and thus reduce the length of the usable workpath.

The floating block may be arranged to overlap a sheave of the crown block or travelling block in such a way that it is nested or nestled amongst, within or between the sheaves of the crown block or the travelling block. The sheaves of the floating block may be arranged to nest amongst the sheaves of the crown block or the travelling block. The sheaves of the floating block, or the entire floating block, may be nested between groups of sheaves of the crown block or the travelling block.

The sheaves of the floating block may totally overlap a sheave of the crown block or a travelling block in a direction of the workpath when the floating block is in one of the first or second arrangement. A total overlap of the sheaves of the floating block with a (or each) of the sheaves of the crown block or travelling block may be such that the sheaves of the floating block are axially aligned with a sheave of the crown block or travelling block, i.e. the axis of rotation of the sheaves of the floating block and that of the sheave(s) of the crown block or travelling block are collinear.

In some embodiments the axis of rotation of sheaves of the crown block and/or travelling block may be slightly offset from those of the floating block. In such situations, a total overlap of the sheaves may be achieved when the axis of rotation of the sheaves of the floating block and one of the crown block and travelling block are equidistant from the axis of rotation of the other of the crown block or travelling block.

When there is a total overlap, the sheaves of the floating block may not be visible from the side of an arrangement as depicted in FIG. 1. In the case where the sheaves of the floating block and the crown block or travelling block are not of equal size, a total overlap may refer to the entirety of the sheaves of the floating block overlapping a part of a sheave of the crown block or travelling block; or the entirety of a sheave of the crown block or travelling block overlapping a part of a sheave of the floating block.

Ideally, the floating block is arrangeable such that the sheaves of the floating block can be arranged to totally overlap and be parallel to the sheaves of at least one of the crown block or floating block. This provides an arrangement whereby the inclusion of the floating block does not impact the usable workpath at all, since it effectively nests within the crown or travelling block and thus does not impede movement of the travelling block at any point along the length of the workpath.

The sheaves of the floating block may not extend in the direction of the workpath any further than the sheaves of the crown block or travelling block when the floating block is in one of the first or second arrangements. The floating block may be arranged to be totally encompassed by the outer bounds of one of the crown block or the travelling block when in one of the first or second arrangements.

The sheave arrangement of the crown block, travelling block and/or floating block of the hoisting system may be symmetric about a centreline of the workpath or a plane through this centreline. A symmetric arrangement of sheaves will ensure that the lifting force is balanced across the travelling block and payload, such that the resultant lifting force acts along the centreline of the workpath. An uneven, unbalanced or off-centre lifting force will result in tipping of the payload and potential damage to the wellbore or associated equipment.

The plurality of sheaves of at least one of the crown block and the travelling block may be axially separated into two sheave groups, and the floating block may be arranged to be located at least partially between the two sheave groups when the floating block is in one of the first and second arrangements.

The plurality of sheaves of the floating block may be axially separated into two sheave groups, and at least one sheave of the crown block or travelling block may be arranged to be located at least partially between the two sheave groups when the floating block is in one of the first and second arrangements. Each floating block sheave group may comprise an attachment device or means for attaching the respective group to the crown block or travelling block.

An example arrangement which may ensure a balanced lifting force is one whereby the sheaves of one of the blocks (the crown block, floating block or travelling block) are separated into two sheave groups with a gap thereinbetween. The gap may be such that the sheaves of one of the other blocks can be arranged therein. For example, the floating block may be arranged to be fixed/attached between two sheave groups of the crown block or travelling block.

The plurality of sheaves of the travelling block may be arranged into two, axially-separated groups. Each group of sheaves may comprise three sheaves. The two groups of sheaves may be axially spaced. The floating block may comprise three sheaves. The floating block may be arranged to be located between to two axially-separated groups of sheaves of the travelling block when the floating block is in the second arrangement. When in the second arrangement, the sheaves of the floating block may be arranged to be nested amongst the sheaves of the travelling block. The floating block may be arranged such that the sheaves of the floating block totally overlap the sheaves of the floating block when the floating block is in the second arrangement. The sheaves of the floating block may be coaxial with the sheaves of the travelling block when the floating block is in the second arrangement.

The hoisting system may comprise a single attachment device for attaching a plurality of the sheaves of the floating block to at least one of the crown block and the travelling block.

To allow a user to quickly effect a large change in the lift ratio of the hoisting system, a single attachment device may be arranged to fix the entire floating block in the first and/or second arrangement. This allows a user to more easily implement a required change to the lift ratio (say requiring the movement of 3 sheaves), since only a single attachment/detachment device needs to be operated, rather than one attachment device for each sheave. The increased speed with which a plurality of sheaves can be attached/detached may increase efficiency when changing between hoisting system load ratings.

The attachment device may be arranged such that when the floating block is attached to the at least one of the crown block and the travelling block by means of the attachment device, the sheaves of the floating block totally overlap a sheave of the crown block or travelling block.

The hoisting system may alternatively comprise an attachment device for each of the sheaves of the floating block for attaching each sheave of the floating block to at least one of the crown block and the travelling block individually. This provides more flexibility and resolution when selecting the lift ratio change.

The hoisting system may further comprise a winch engaged with the hoisting cable at a first end. The hoisting system may comprise a winch engaged with the hoisting cable at the second end, to increase the lifting speed.

Alternatively, the hoisting system may further comprise an anchor engaged with the hoisting cable at a second end.

The hoisting system may comprise a heave compensator. The heave compensator may be for, or configured to, compensate for motion, such as wave motion. The motion may be vertical motion. The motion may be of the hoisting system, anchor, winch, rig, derrick, or vessel. The motion may be caused by waves or the tides.

The heave compensator may comprise an active heave compensator or be configured to provide active heave compensation. The heave compensator may comprise a passive heave compensator or be configured to provide active heave compensation.

Active heave compensation may comprise the use of power to actuate a component in response to a signal indicating motion. Passive heave compensation may comprise allowing passive movement of a component caused by motion.

When using the hoisting system on an ocean-based vessel or rig, vertical motion relative to the seabed may be induced by, for example, waves and tides. In order to keep the payload (e.g. a drill string) at a constant height relative to the seabed, or to ensure the payload is raised or lowered at a constant absolute velocity, the heave compensator may be employed. Compensating for motion may therefore be to minimise the impact of vertical motion of the vessel or rig on the position of the payload relative to the seabed.

In order to compensate for motion, the hoisting system (or derrick/vessel on which the system is installed) may comprise sensors for monitoring the motion of the surface of the ocean or the derrick/vessel. The heave compensator may be configured to provide heave compensation (e.g. active heave compensation) in order to counter this motion.

The heave compensator may be associated with the winch. The winch may be comprised to provide heave compensation. The winch may be configured to provide active or passive heave compensation. The winch may be configured to provide heave compensation by controlling the spooling rate to compensate for motion. The rate of spooling/despoiling may be controlled to minimise the effect of motion of the hoist system, rig or vessel on the movement or location of the payload relative to the seabed.

The heave compensator may comprise a crown compensator. The crown compensator may be a crown mounted compensator. The crown compensator may be for providing heave compensation. The crown compensator may be for providing active or passive heave compensation.

The crown compensator may be arranged to facilitate (vertical) movement of the crown block to compensate for motion, such as wave motion.

The crown compensator may be arranged to allow the raising or lowering of the crown block to compensate for motion (for example of the hoisting system, derrick or vessel). The crown block may be arranged within the crown compensator to move in response to motion (e.g. wave motion of the hoisting system, derrick or vessel) in order to compensate for the motion.

The crown compensator may be arranged to move the crown block to compensate for motion (for example of the hoisting system, derrick or vessel). The crown compensator may actively move the crown block to compensate for motion.

The crown block may move relative to a derrick, rig or vessel on which the hoisting system is installed. The crown block may move relative to the winch, anchor or travelling block. The crown compensator may also be arranged to facilitate the movement of the winch and/or anchor to compensate for wave motion. The crown compensator may also be arranged to facilitate the movement of the crossover sheave/crossover sheave arrangement/assembly to compensate for wave motion.

The heave compensator may be configured for selective utilisation/activation. The heave compensator may be configured to be activated and deactivated. The heave compensator may be configured to selectively employ only one of the winch or the crown compensator to provide heave compensation at a time. The heave compensator may be configured to selectively employ both of the winch or the crown compensator to provide heave compensation. The heave compensator may be configured to selectively provide only one of, or both of, active or passive heave compensation.

The winch may be used to provide active heave compensation. Active heave compensation may be configured to be active when lifting or lowering components from/to the seabed, for example when tripping in or tripping out. Active heave compensation may be configured to be active when in a heavy lift mode, i.e. when the maximum number of sheave pairs are employed when hoisting components. As an example, the active heave compensation may be active when landing out the blow out preventer or a heavy string of casing.

The crown compensator may be configured to provide passive heave compensation. The heave compensator may be configured to utilise the crown compensator to provide passive heave compensation when the hoisting system is in a locked to bottom mode. This may be when the payload (e.g. a string) is physically attached to a component on or near the seabed, for example during a well test.

The heave compensator may use the crown compensator when the hoisting system is in a light lift mode, i.e. when less than the maximum number of sheave pairs are employed.

The heave compensator may use passive heave compensation during operations such as drilling and well testing.

The winch may be parked, or locked, when the crown compensator is providing heave compensation. The crown compensator may be parked, or locked, when the winch is providing heave compensation.

The heave compensator may be configured such that at least one of active and passive heave compensation is in use at all times during operation of the hoisting system.

The crown compensator may comprise a supporting frame. The supporting frame may comprise a mast, or pair of masts. The supporting frame may comprise vertical guides for vertically guiding the crown block in vertical motion. The vertical guides may comprise runners along which the motor element drives the crown block.

The supporting frame of the crown compensator may define an opening, hole or space. The two masts and/or vertical guides may define a spacing therebetween. The opening/spacing may be arranged vertically above the well (and thus the crown block or a crossover sheave). The opening/spacing may be for receiving at least part of the crown block or a crossover sheave when the crown block is at its uppermost position in the crown compensator. The opening/spacing may be arranged such that, when the crown block and a crossover sheave have been moved to their uppermost position by the crown compensator, the crossover sheave is at least partially located in the opening/spacing.

A crossover sheave assembly may comprise a crossover sheave arranged vertically above the crown block. The hoisting system may be arranged such that the crown compensator is arranged to move, or facilitate the movement of the crown block and the crossover sheave arranged above the crown block.

For providing active heave compensation, the crown compensator may comprise a motor for vertically driving the crown block and a processor and memory configured to actuate the motor to compensate for wave motion.

The crown compensator may comprise a damper or dissipation means for resisting vertical movement of the crown block, for example when providing passive heave compensation.

The hoisting cable may be reeved such that the portion of the hoisting cable reeved around a sheave of the floating block forms part of the deadline when the floating block is in one of the first and second arrangements. The deadline comprises the part of the hoisting cable that does not move over the surface of a sheave during use of the hoisting system. The deadline does not generate any friction or wear and so it is advantageous to maximise the length of the deadline where possible.

The hoisting cable may be reeved with a sheave of the floating block arranged closer than the sheaves of at least one of the crown block and the travelling block, to the anchor, such that the portion of the hoisting cable reeved around the sheave of the floating block forms part of the deadline when the floating block is in one of the first and second arrangements.

The hoisting system may further comprise a crossover sheave assembly. The crossover sheave assembly may comprise at least one crossover sheave. The crossover sheave may be arranged such that the sheaves of the crown block, travelling block and/or floating block can be reeved onto the hoisting cable in an order which is different to the order in which they are attached to the respective block. The crossover sheave may be arranged such that the sheaves of the crown block, travelling block and/or floating block can be reeved onto the hoisting cable in an order which maximises the deadline when the floating block is in one of the first and second arrangements.

A crossover sheave assembly may comprise a plurality of crossover sheaves arranged above the crown block. The crossover sheave assembly may allow the selection of the order in which the sheaves of the crown block, travelling block and floating block are reeved onto the hoisting cable.

The crossover sheave assembly may comprise attachments members for attaching the crossover sheave assembly to the derrick or crown block.

A crossover sheave may be reeved on the hoisting cable between a first sheave of one of the crown block, travelling block or floating block and a second sheave of one of the crown block, travelling block or floating block; the crossover sheave may be arranged perpendicularly or obliquely to the first and second sheave. A crossover sheave may be arranged such that two sheaves which are not spatially consecutive can be consecutively reeved onto the hoisting cable (albeit separated by the crossover sheave).

The travelling block may comprise the floating block and the floating block may form a detachable module of the travelling block. The floating block may be suspended from the crown block via the hoisting cable.

In a specific embodiment, the floating block may form a detachable module of the travelling block.

The plurality of sheaves of the travelling block may be axially separated into two sheave groups, and the floating block may be attachable to the travelling block between the two sheave groups. When attached to the travelling block (i.e. in the second arrangement), the sheaves of the floating block may totally overlap the sheaves of the travelling block.

The hoisting system may comprise:

a winch engaged with the hoisting cable at a first end;

an anchor engaged with the hoisting cable at a second end; and a crossover sheave arrangement;

wherein the crossover sheave arrangement comprises a crossover sheave and is arranged such that a sheave of the floating block is arranged on the hoisting cable at a location closer than a sheave of the travelling block, to the anchor.

This arrangement may provide that the sheave of the travelling block forms part of the deadline when the floating block is arranged in the first arrangement and is fixed relative to the crown block.

The crossover sheave arrangement may be arranged such that all of the sheaves of the floating block are arranged on the hoisting cable at a location closer than all of the sheaves of the travelling block, to the anchor.

The crossover sheave arrangement may further comprise a second crossover sheave. The first crossover sheave may be arranged to sequentially reeve the two sheave groups of the travelling block on the hoisting cable. The second crossover sheave may be arranged to reeve the sheaves of the floating block onto the hoisting cable closer than the sheaves of the travelling block, to the anchor.

It should be noted that the term sequentially, as used herein, means that the two sheave groups are reeved onto the hoisting cable without any intervening floating block sheaves. There will still be sheaves of the crown block reeved onto the hoisting cable interspersed with the travelling block sheaves, in order to form pulley pairs.

All of the floating block sheaves may be arranged closer than the travelling block sheaves to the anchor. This will maximise the size of the deadline.

The travelling block may comprise an even number of sheaves separated into two axially separated sheave groups of equal number. The floating block may comprise an attachment device and may be arranged to be attached to the travelling block between the two sheave groups such that the sheaves of the floating block totally overlap the sheaves of the travelling block. The sheaves of the floating block may be coaxial with the sheaves of the travelling block.

The travelling block may comprise six sheaves separated into two axially separated sheave groups of three, and the floating block may comprise three sheaves and an attachment device. The floating block may be arranged to be attached to the travelling block between the two sheave groups such that the sheaves of the floating block are coaxial with the sheaves of the travelling block.

The crossover sheave assembly may be arranged such that all of the sheaves of the floating block, locatable between the two axially separated groups of travelling block sheaves, are arranged or arrangeable on the hoisting cable such that they form part of the deadline when the floating block is in the first arrangement. The floating block sheaves may be locatable closer to the anchor than all of the sheaves of the travelling block.

The hoisting system may be arranged to provide two lifting ratios, a first lifting ratio when the floating block is fixed relative to the crown block, and a second lifting ratio when the floating block is fixed relative to the travelling block.

The hoisting system, derrick or ship on which the system is installed may comprise a guide dolly arrangement. The dolly arrangement may be arranged to guide movement of a payload and/or the travelling block during lifting/lowering of a payload. The dolly arrangement may be arranged to vertically guide the payload and/or travelling block. The dolly arrangement may be arranged to vertically guide the payload and/or travelling block aligned to the centre of the well. The dolly arrangement may ensure the payload and/or travelling block is aligned with the centre of the well and cannot rotate during hoisting operations.

The dolly arrangement may comprise a plurality of guide rails and rollers arranged to travel along the guide rails.

The dolly arrangement may comprise a retract system for moving the travelling block and/or payload horizontally to aid when attaching/detaching components to/from the travelling block. The retract system may comprise a powered arm to move the travelling block and/or part of the payload horizontally away from the centre of the well. Moving the travelling block and/or payload (e.g. a top drive) away from the centre of the well frees up space for a stand being tripped in or tripped out to be moved into position while the travelling block/payload is hoisted/lowered. The retract system may facilitate quicker tripping in or out of the well. The retract system may be configured to move the travelling block and a stand away from the centre of the well such that the pipe stand can be more easily racked by a pipe racker.

The sheaves of any or all of the crown block, travelling block and floating block may be arranged with their axis of rotation passing through the dolly arrangement (i.e. the flat side of the sheaves facing the dolly arrangement), or perpendicular to the direction of the dolly. The crossover sheave(s) may be arranged with their axis of rotation passing through the dolly arrangement (i.e. the flat side of the sheaves facing the dolly arrangement), or perpendicular to the direction of the dolly.

The orientation of the sheaves of the hoisting system may depend on the space available and the range of movement provided by a retract system of the dolly arrangement. The hoisting system must be arranged such that the retract system of the dolly arrangement can manoeuvre the travelling block and/or payload sufficiently far from the centre of the well to avoid abutment with a pipe stand being tripped in or out.

Having a sheave arrangement in which the floating block nests within one of the crown block and the travelling block provides a compact arrangement and hence maximises the usable work path. This can allow pipe stands to be added or removed sooner during tripping operations.

For example, when the plurality of sheaves of at least one of the crown block and the travelling block are axially separated into two sheave groups, and the floating block is arranged to be located at least partially between the two sheave groups when the floating block is in one of the first and second arrangements, the presence of the floating block does not impede on the length of the work path compared to a system without a floating block. This ensures that the tripping speed is not affected by the presence of the floating block.

The hoisting system may comprise a control system. The control system may comprise any of the following: user input configured to receive an input from a user; a controller configured to execute readable instructions; a storage device for storing the readable instructions; and actuators arranged to move the floating block between a first and second arrangement. The controller may be configured to, upon executing the readable instructions, actuate an actuator to move the floating block between the first and second arrangement in response to an input received from a user.

The hoisting system may comprise attachment means or devices for retrofitting the hoisting system to a rig.

According to a further aspect or example is a derrick comprising a hoisting as described herein, the hoisting being arranged for lifting and lowering a payload. The payload may comprise a top drive attached to the travelling block, and then subsequent components, referred to as the net-payload, attached to the top drive.

The aspects described herein allow a hoisting to be retrofitted to an existing derrick or rig. This may allow an existing drilling rig to be converted for a different use, rather than requiring a new rig.

The hoisting system may be for attachment to a new derrick or rig, or for being retrofitted to an existing derrick or rig.

There is an emerging desire within the offshore industry to convert existing deepwater drilling rigs rather than building new vessels. To do this, the maximum hoisting load may need to be increased by up to or exceeding 50%. Accordingly there is a demand for hoisting systems which can provide such flexibility in maximum hoisting loads.

According to a further aspect or example is a drilling ship comprising a derrick as described herein.

According to a further aspect or example is a method for changing the lifting ratio of a hoisting, the method comprising:

moving a floating block comprising a plurality of sheaves between a first arrangement, in which it is fixed relative to a crown block, and a second arrangement, in which it is fixed relative to the travelling block.

The ratio may be manually operated by manually moving the floating block.

The ratio may be automatically operated via a control system.

According to a further aspect is a method for modifying a derrick or a rig, wherein a hoisting system as described herein is fitted, or retrofitted, in the derrick or rig.

BRIEF DESCRIPTION OF DRAWINGS

FIG. 3B is a schematic illustration of no overlap of the floating block and the crown block;

FIG. 1 illustrates part of a derrick and an example hoisting system 10. FIG. 2A is a diagrammatic representation of the same hoisting system 10. The derrick and hoisting system 10 are suitable for use on a drilling ship, for example. The hoisting system 10 is associated with a work centre. The hoisting system 10 comprises a crown block 12 which is restrained relative to the derrick and a travelling block 14 which is suspended from the crown block 12 by a hoisting cable 16. Each of the crown block 12 and the travelling block 14 comprises a plurality of sheaves.

Figure 1:
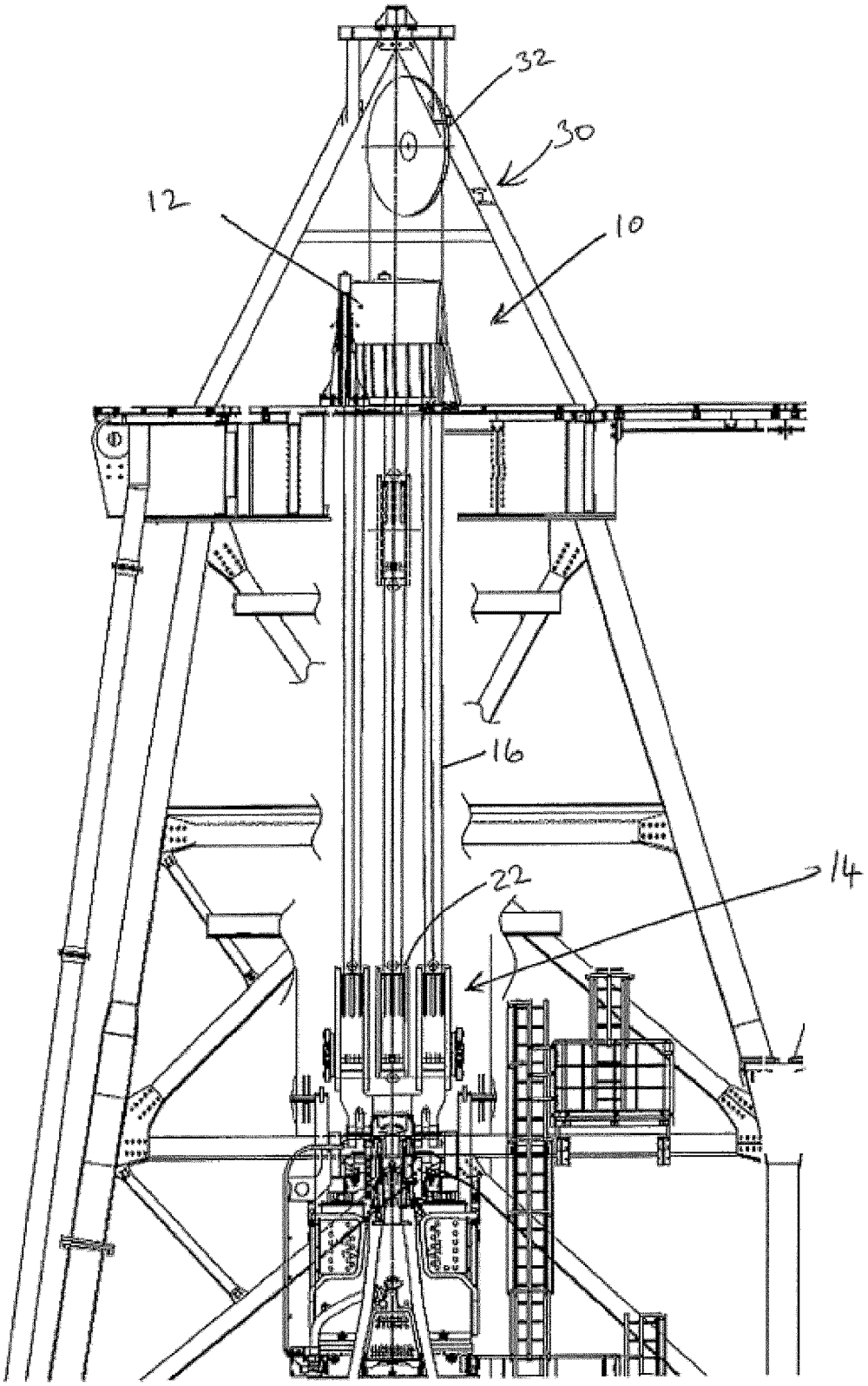
FIG. 1 is a side elevation view of an example hoisting system.

The travelling block 14 has connectors such that a payload (e.g. a top-drive) can be attached, and thus suspended, from the travelling block 14. One end of the hoisting cable 16 is associated with a winch 18 for drawing the hoisting cable 16 in, and the other end of the hoisting cable is attached to an anchor 20, for fixing that end of the hoisting cable 16. In some examples, the anchor 20 may be replaced with a second winch.

As the winch 18 draws in the hoisting cable 16, the travelling block 14 moves towards the crown block 12 along the workpath. In this manner, any payload attached to the travelling block 14 is also lifted vertically along the workpath.

The hoisting system 10 also comprises a winch sheave 26 and an anchor sheave 28 for assisting in introducing the hoisting cable 16 into the crown block 12, travelling block 14 or floating block 22 from the winch 18 and anchor 20, respectively.

In accordance with known systems, the portion of the hoisting cable 16 extending from the anchor 20 which does not move over the surface of a sheave during the movement of the travelling block 14 is referred to as the deadline 16*a*. The portion of the hoisting cable 16 which does move over a sheave during movement of the travelling block is referred to as the fastline 16*b*. In the diagrammatic figures the deadline 16*a* is illustrated with a broken line.

The hoisting system 10 also comprises a floating block 22. The floating block 22 comprises a plurality of sheaves 23*a-c*. The floating block 22 is arranged to move between a first and second arrangement. In the first arrangement the floating block 22 is in a first position—fixed relative to the crown block 12. This means that the floating block 22 does not move relative to the crown block 12 with the travelling block 14. In this example, the floating block 22 is located at the top of the workpath and is parked adjacent the crown block 12. This configuration is illustrated by the broken lines in FIG. 1 and in FIG. 3. Since in this arrangement the floating block does not move relative to the crown block, the sheaves 23*a-c* of the floating block 22 do not contribute to the force/displacement magnification effect of the hoisting system 10. Accordingly, the force amplification is determined by the number of sheaves of the travelling block 14.

In the second arrangement (shown in solid lines in FIG. 1 and in FIG. 2A), the floating block 22 is in a second position—fixed relative to the travelling block 14. This means that the floating block 22 moves as one with the travelling block 14. In this example, the floating block 22 is located between two symmetric groups of travelling block sheaves 15*a-f*. Since the sheaves 23*a-c* of the floating block 22 now move relative to the sheaves 13*a-f* of the crown block 12, the sheaves 23*a-c* of the floating block 22 now contribute to the force/displacement magnification effect of the hoisting system 10. Accordingly, the force amplification is determined by the combined number of sheaves of the travelling block 14 and floating block 22. This provides a different gearing/lifting ratio compared to that when the floating block 22 is fixed relative to the crown block.

In the example of FIGS. 1 to 3, the floating block 22 has 3 sheaves. The floating block 22 having a plurality of sheaves results in a bigger difference between the two lifting ratios of the hoisting system 10. A single attachment device 24 is provided to attach the whole of the floating block 22 to the travelling block 14. A further, or the same, attachment device may be provided for attaching the floating block 22 to the crown block 12.

The arrangement of the hoisting system 10 of FIGS. 1 to 3 is such that the sheaves 15*a-f* of the travelling block 14 are arranged in two groups. The two groups of sheaves are axially separated and the hoisting system 10 is arranged such that in the second arrangement the floating block is located between the two groups of sheaves, such that the sheaves 23*a-c* of the travelling block 22 are substantially coaxial with the sheaves 15*a-f* of the travelling block 14, i.e. there is a total overlap. The two groups of travelling block sheaves comprise the same number of sheaves and are substantially symmetric (i.e. equally spaced from a centreline of the workpath). This means that the lift provide by the hoisting system is even and the centre of lift acts through the centreline of the workpath 11.

Figure 3A:
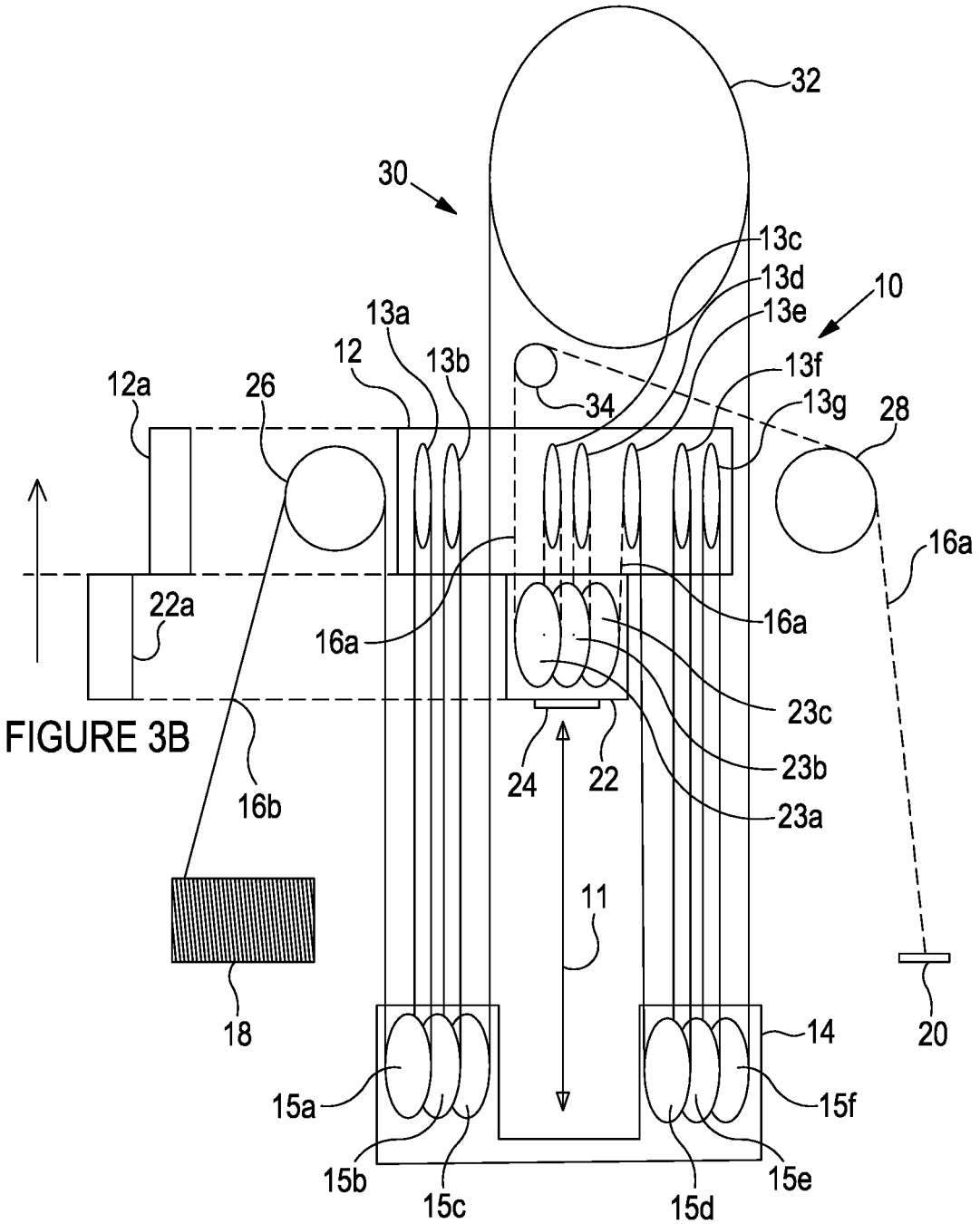
FIG. 3A is a diagrammatic view of the hoisting system of FIG. 1, shown with a second lifting ratio.

The workpath 11 is illustrated in FIG. 3A and is the up and down travel of the travelling block.

The above arrangement ensures that the length of the workpath is not reduced by the inclusion of the floating block 22. Since the floating block 22 is arranged to nest amongst the sheaves 15*a-f* of the travelling block, it does not block or inhibit the movement of the travelling block 14 along any portion of the workpath, regardless of whether the floating block 22 is in the first or the second arrangement. This maximises the length of the workpath for a given distance between the crown block 12 and the travelling block 14.

Figures 2A, 2B:
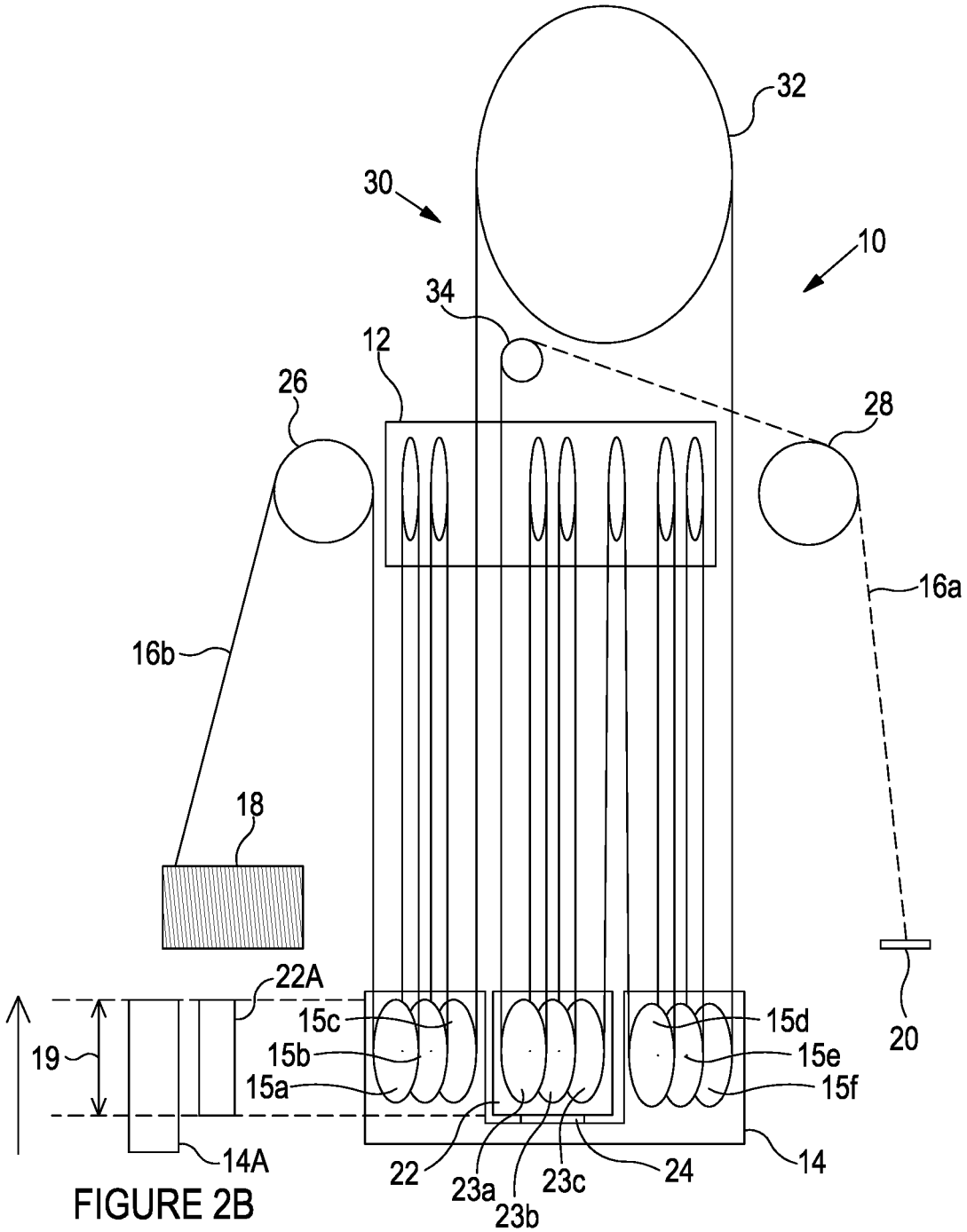
FIG. 2A is a diagrammatic view of the hoisting system of FIG. 1, shown with a first lifting ratio.
FIG. 2B is a schematic illustration of an overlap of the floating block and the travelling block.

FIGS. 2B and 3B illustrate the concept of sheaves of the floating block overlapping a, or all, of the sheaves of the crown block or the travelling block in the direction of the workpath 11. FIG. 2B schematically illustrates the positions of the travelling block 14A and floating block 22A with respect to the direction of the workpath 11 (illustrated by the arrow). As can be seen, the totality of the sheaves of the floating block 22A overlap those of the travelling block 14*a* in a direction of the workpath 11. The extent of the overlap is illustrated by the double ended arrow 19. This is a total overlap.

Turning now to FIG. 3B, it can be seen that in the direction of the workpath 11 (illustrated by the arrow), there is no overlap of the floating block 22*a* and the crown block 12*a*.

The hoisting system 10 also comprises a crossover sheave assembly 30 (as seen in FIGS. 2 and 3). The crossover sheave assembly is arranged to extend the deadline 16*a* when the floating block 22 is in the first arrangement. This results in the part of the hoisting cable 16 which is reeved around the sheaves 23*a-c* of the floating block 22 forms part of the deadline 16*a*. This means that the sheaves 23*a-c* of the floating block 22 and the associated sheaves 13*c-e* of the crown block 12 do not rotate in response to movement of the hoisting cable 16 by the winch 18. This provides the advantages of reduced wear on this section of the hoisting cable 16*a* and reduced friction opposing the movement of the hoisting cable 16, travelling block 14 and thus payload.

In order to achieve this in the present example, the sheaves 23*a-c* of the floating block 22 need to be reeved onto the hoisting cable 16 at a location on the hoisting cable 16 which is closer to the anchor 20 than the sheaves 15*a*-15*f* of the travelling block. In the present example the crossover sheave assembly comprises a primary crossover sheave 32 and a secondary crossover sheave 34. The primary crossover sheave 32 connects the two groups of sheaves of the travelling block, and so is a large-diameter sheave which extends across the gap formed between the two groups of sheaves. The secondary crossover sheave 34 is located adjacent the anchor sheave 28 on the hoisting cable 16, and facilitates the reeving of the floating block 22 before the travelling block 14, despite the floating block 22 being physically located in the middle of the travelling block 14.

Figure 4:
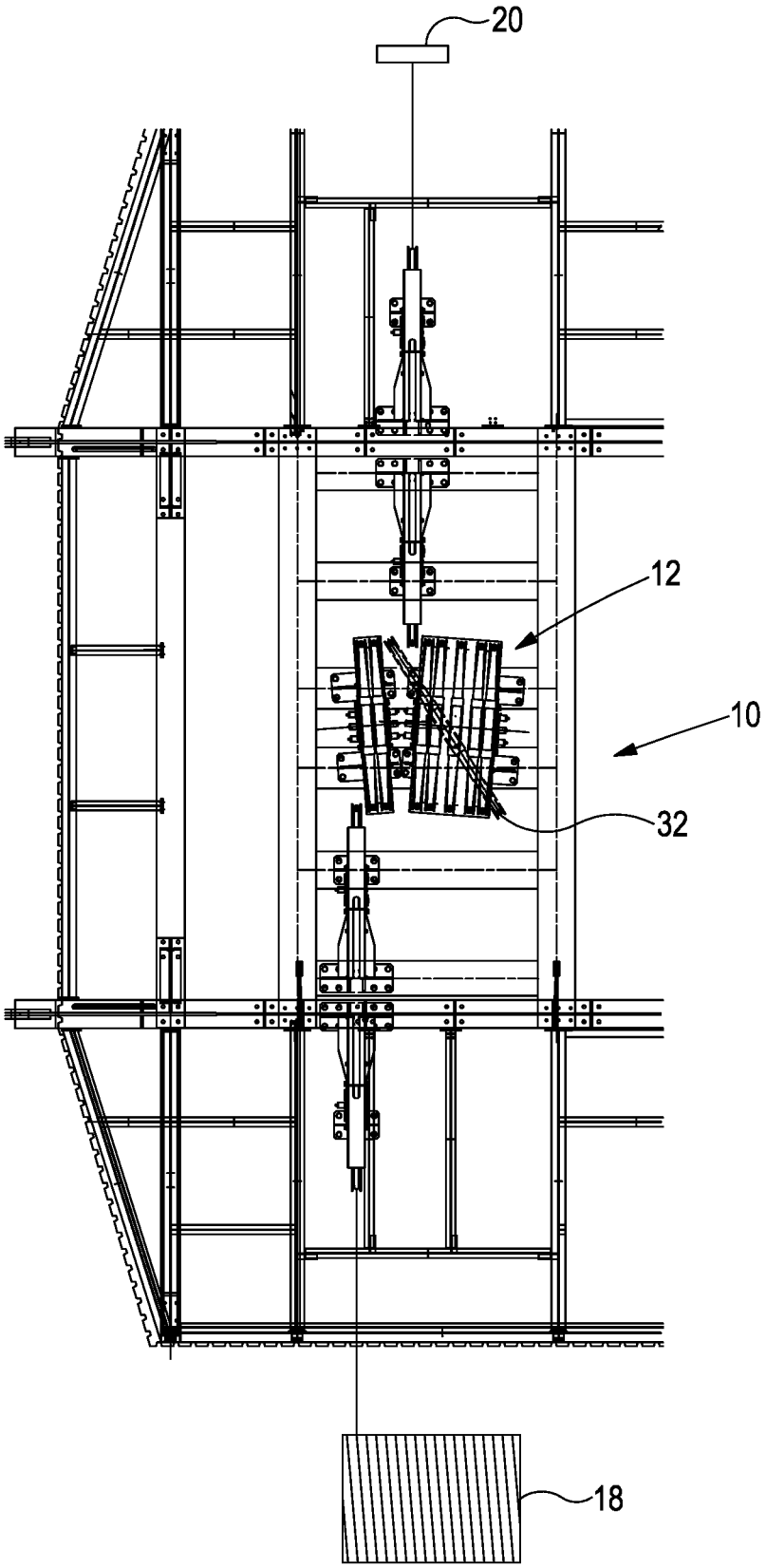
FIG. 4 is a top view of the hoisting system of FIG. 1.

FIG. 4 depicts the hoisting system 10 of FIG. 1 from above.

Figure 5:
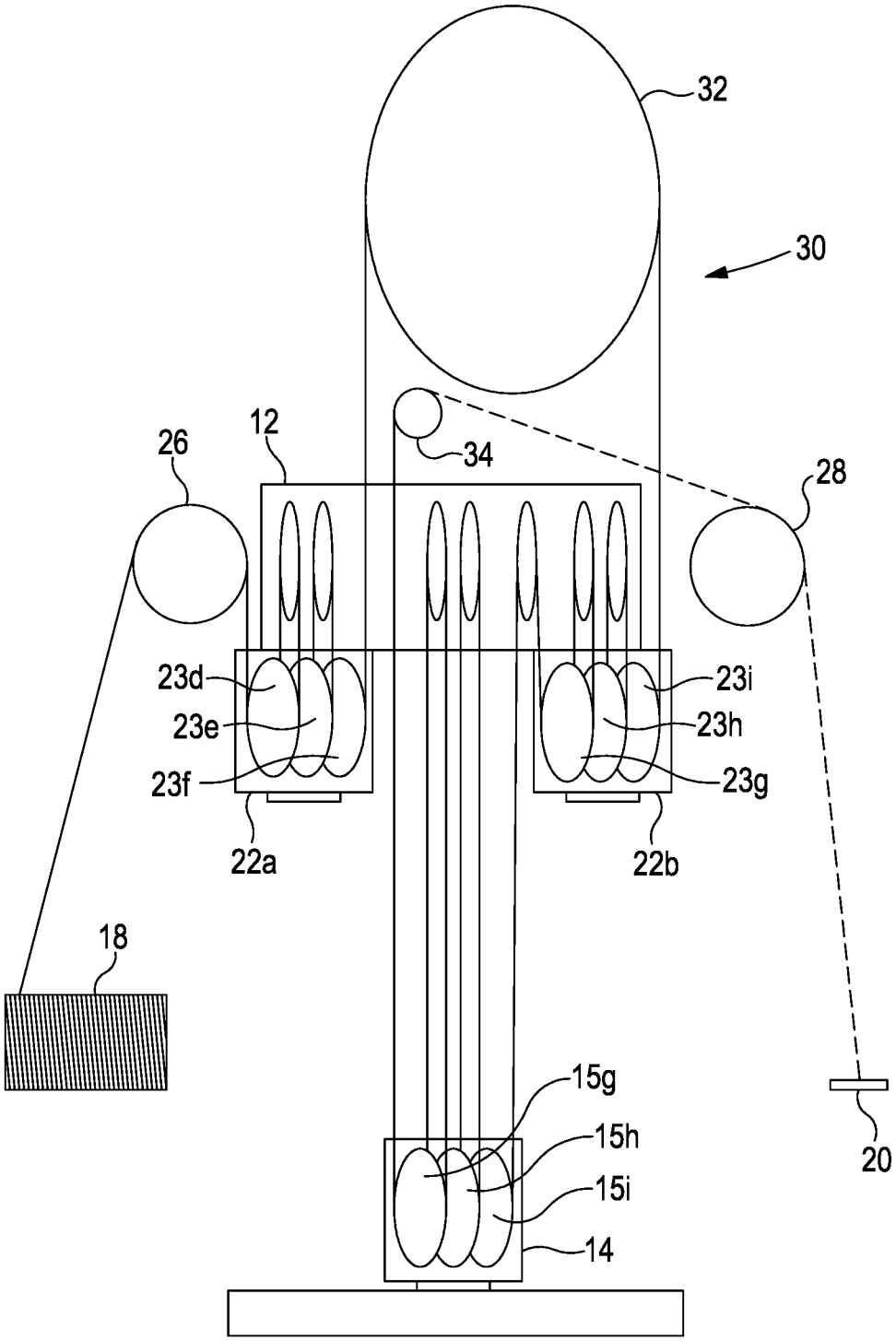
FIG. 5 is a diagrammatic view of a second example hoisting system.

Turning now to FIG. 5, a schematic view of a second example of a hoisting system is shown. In this example, the winch 18, winch sheave 26, crown block 12, crossover assembly 30, anchor sheave 28 and anchor 20 are the same as in the first example. In this embodiment, the travelling block 14 now comprises three sheaves 15*g-i* and the floating block 22 is split into two parts 22*a*, 22*b* each of which comprises three sheaves 23*d-i*. The travelling block 14 is located centrally with respect to the workpath and the floating block parts 22*a,b* are located symmetrically to either side of the travelling block 14.

As before, this example provides two gears, since the two floating block parts 22*a,b* will be connected and disconnected in tandem in order to ensure a lifting force through the centreline of the workpath. The example of FIG. 5 provides a higher maximum lifting speed than the example of FIGS. 1 to 4, since the payload can be lifted with the hoisting cable 16 reeved through only 3 active sheaves on the travelling block, rather than the minimum of 6 in the previous example.

In the example of FIG. 4, the deadline only extends to the secondary crossover sheave 34.

Figure 6:
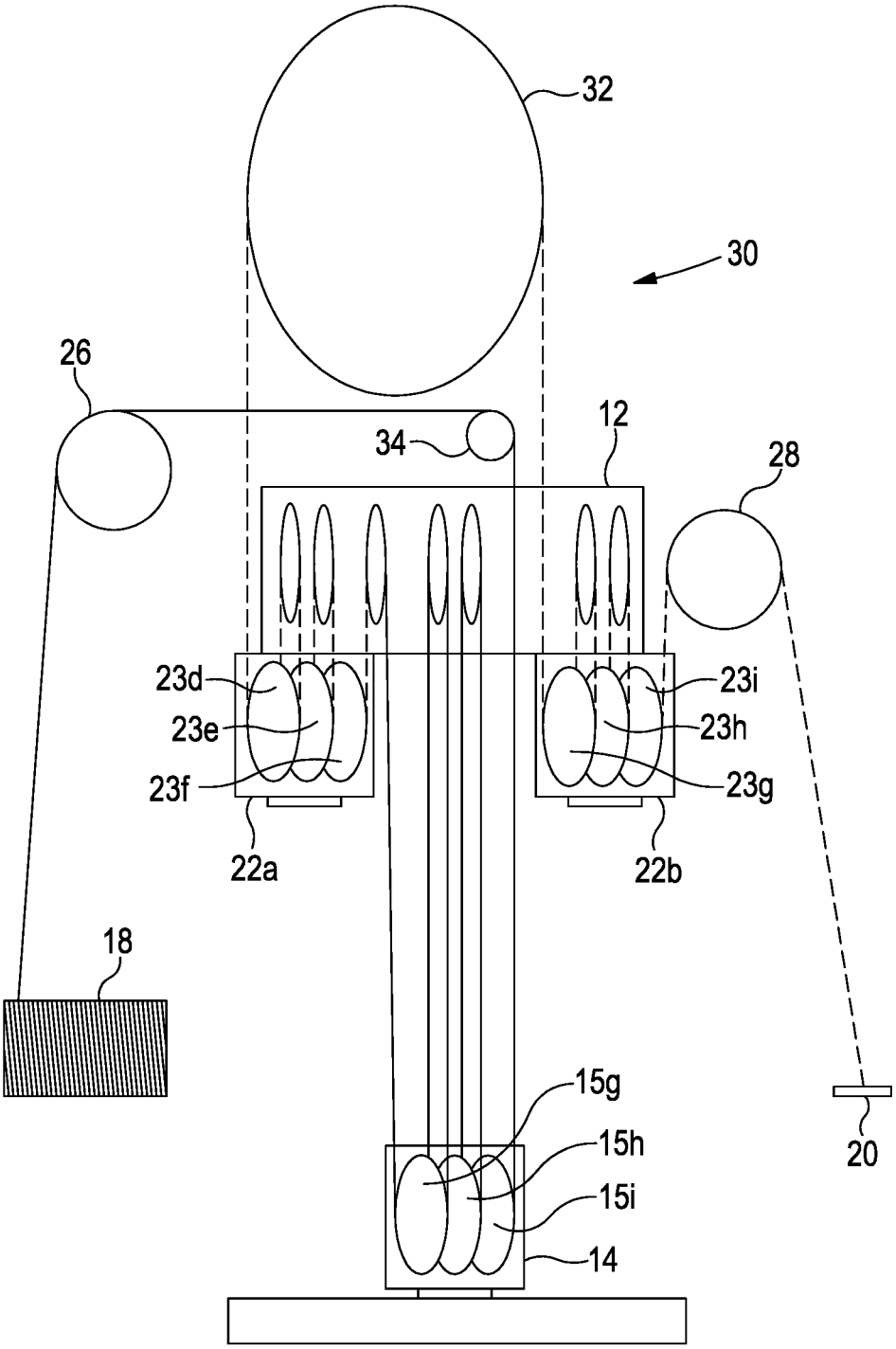
FIG. 6 is a diagrammatic view of a third example hoisting system.

FIG. 6 schematically depicts an example with an identical crown block 12, travelling block 14 and floating block 22 as the previous example, although with a different crossover sheave arrangement 30. In the example of FIG. 6, the winch sheave 26 and the secondary crossover sheave 34 are arranged such that the sheaves 15*g-i* of the travelling block are reeved on the hoisting cable 16 closer to the winch 18 than the sheaves of the floating block 23*d-i*. The primary crossover sheave 32 is arranged to span the portion of the workpath occupied by the travelling block such that the sheaves of both parts of the floating block 23*d-i* can be reeved on the hoisting cable 16 closer to the anchor 20 than the sheaves of the travelling block 14. This results in the deadline extending through all of the sheaves of the floating block 23*d-i* when the floating block 22 is fixed relative to the crown block 12.

Figure 7:
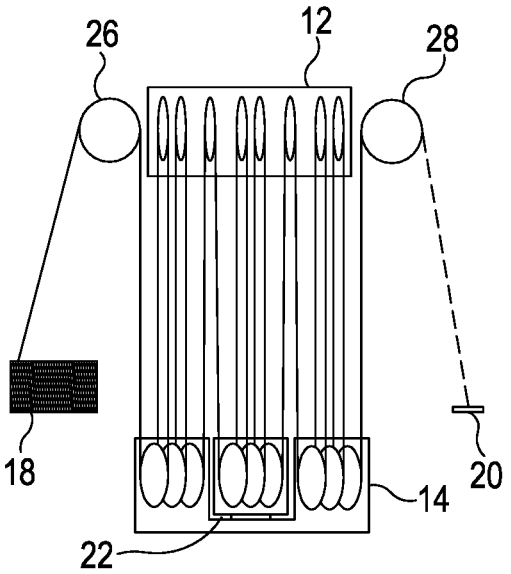
FIG. 7 is a diagrammatic view of a fourth example hoisting system, shown with a first lifting ratio.
Figure 8:
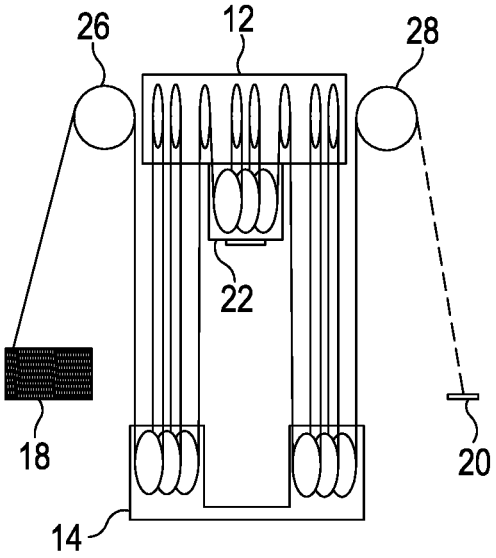
FIG. 8 is a diagrammatic view of the hoisting system of FIG. 7, shown with a second lifting ratio.

FIGS. 7 and 8 schematically illustrate an example with the same crown block 12, travelling block 14 and floating block 22 as the example of FIGS. 1 to 4, but with no crossover sheave assembly 30. As such, the hoisting system 10 comprises fewer sheaves, but the deadline is made shorter (as illustrated by the broken line in the figures).

Figure 9:
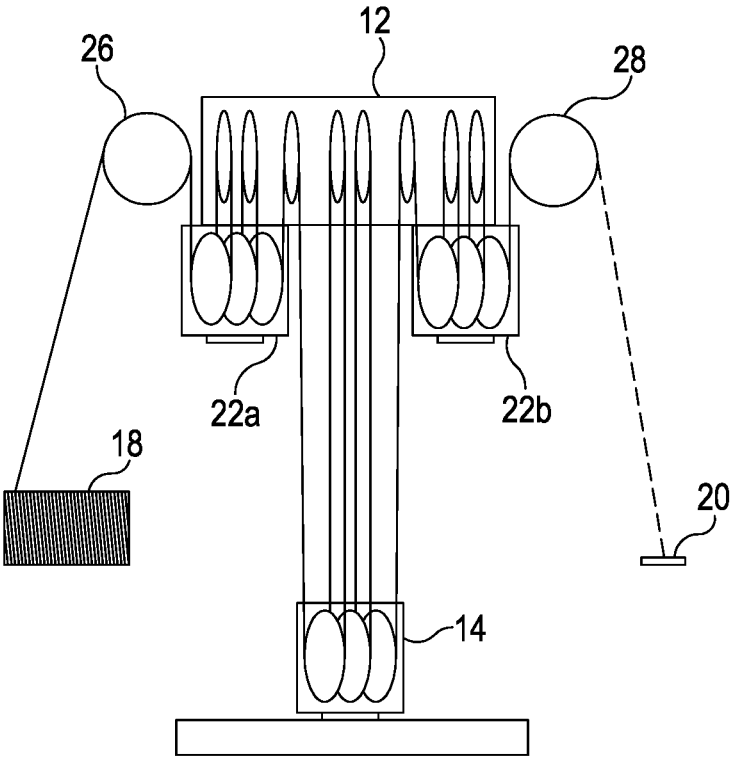
FIG. 9 is a diagrammatic view of a fifth example hoisting system.

FIG. 9 schematically illustrates the example of FIGS. 5 and 6, although with the crossover sheave arrangement removed.

Figure 10:
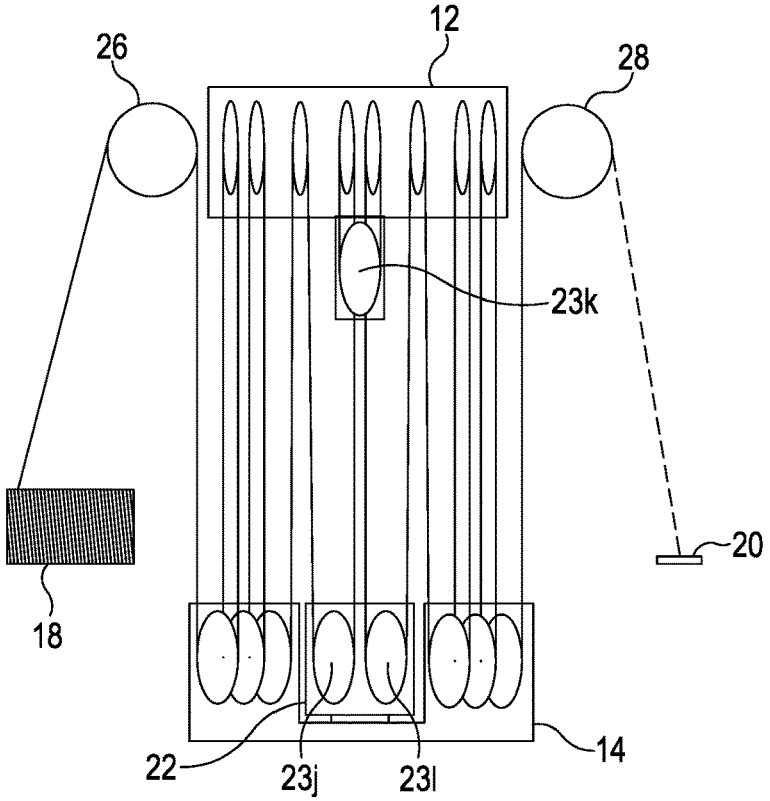
FIG. 10 is a diagrammatic view of a sixth example hoisting system, shown with a first lifting ratio.
Figure 11:
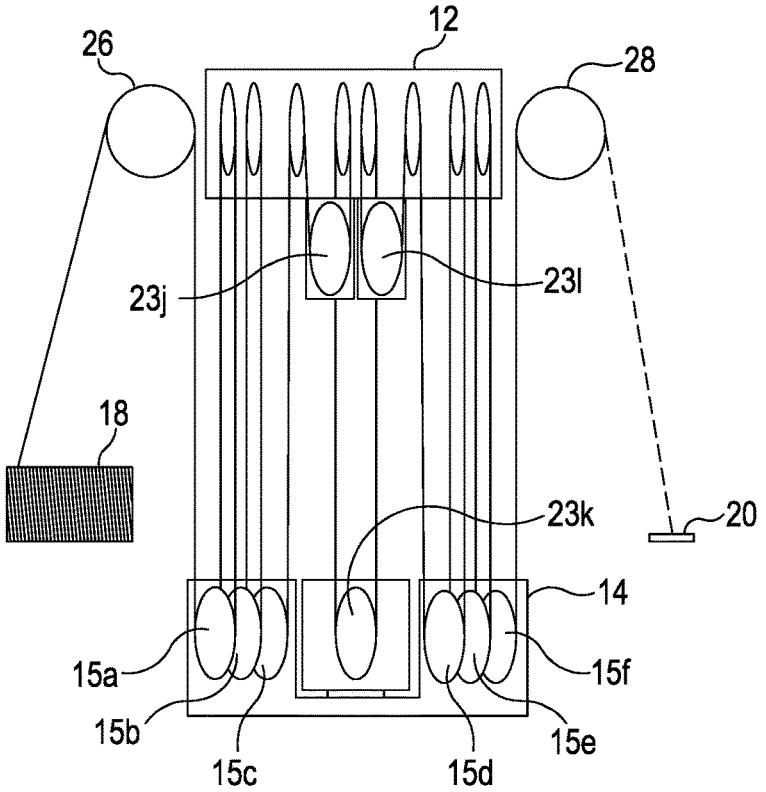
FIG. 11 is a diagrammatic view of the hoisting system of FIG. 10, shown with a second lifting ratio.

In the example of FIG. 10, the sheaves 23*j-l* of the floating block 22 can be separated from the floating block 22 and independently moved between an arrangement in which the sheave is fixed relative to the crown block 12 and an arrangement in which the sheave is fixed relative to the travelling block 14. In FIG. 10, a central sheave 23*k* of three is moved to a position where it is fixed relative to the crown block 12. In FIG. 11, two outer sheaves 23*j,l* of the three floating block sheaves 23*j-l* are moved to a position in which they are fixed relative to the crown block 12.

Figure 12:
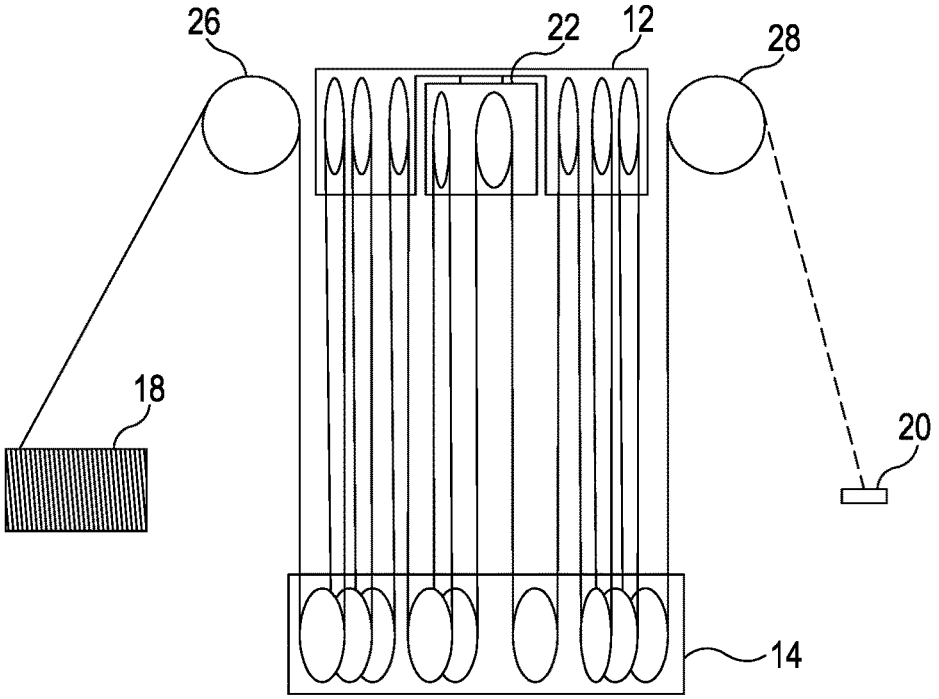
FIG. 12 is a diagrammatic view of a seventh example hoisting system, shown with a first lifting ratio.
Figure 13:
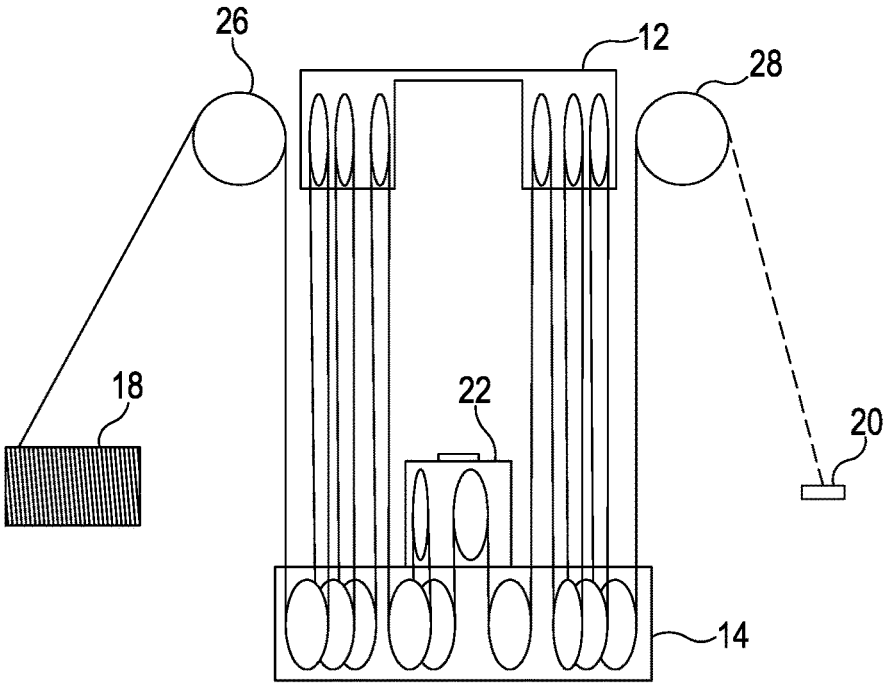
FIG. 13 is a diagrammatic view of the hoisting system of FIG. 12, shown with a second lifting ratio.

In the example of FIGS. 12 and 13, the hoisting system 10 is arranged such that the sheaves of the floating block are reeved on the hoisting cable 16 such that they intersperse sheaves of the travelling block 14, rather than the crown block 12 as in the other examples. As such, the floating block 22 is not suspended from the crown block 12. The principle of this example is, however, identical to preceding examples. In a first arrangement (as shown in FIG. 12), the floating block 22 is arranged in a fixed relationship with respect to the crown block 12 and the lifting/movement ratio is determined by the number of sheaves of the crown block 12 combined with the number of sheaves of the floating block 22. In a second arrangement (as shown in FIG. 13), the floating block 22 is arranged in a fixed relationship with respect to the travelling block 14, and the lifting/movement ratio is determined by the number of sheaves of the crown block 12 alone.

Figure 14:
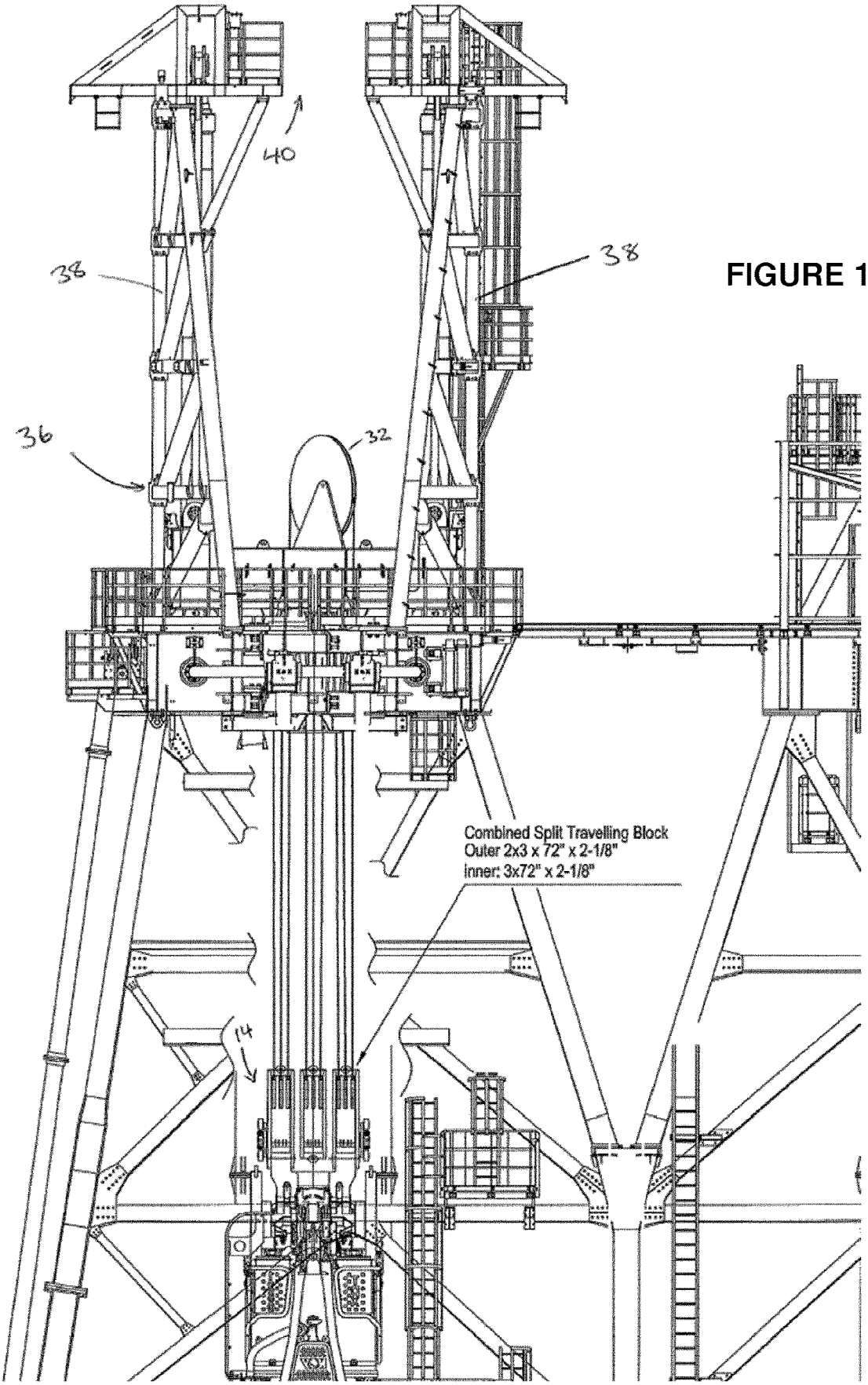
FIG. 14 is a side elevation view of an example hoisting system comprising a crown compensator.
Figure 15:
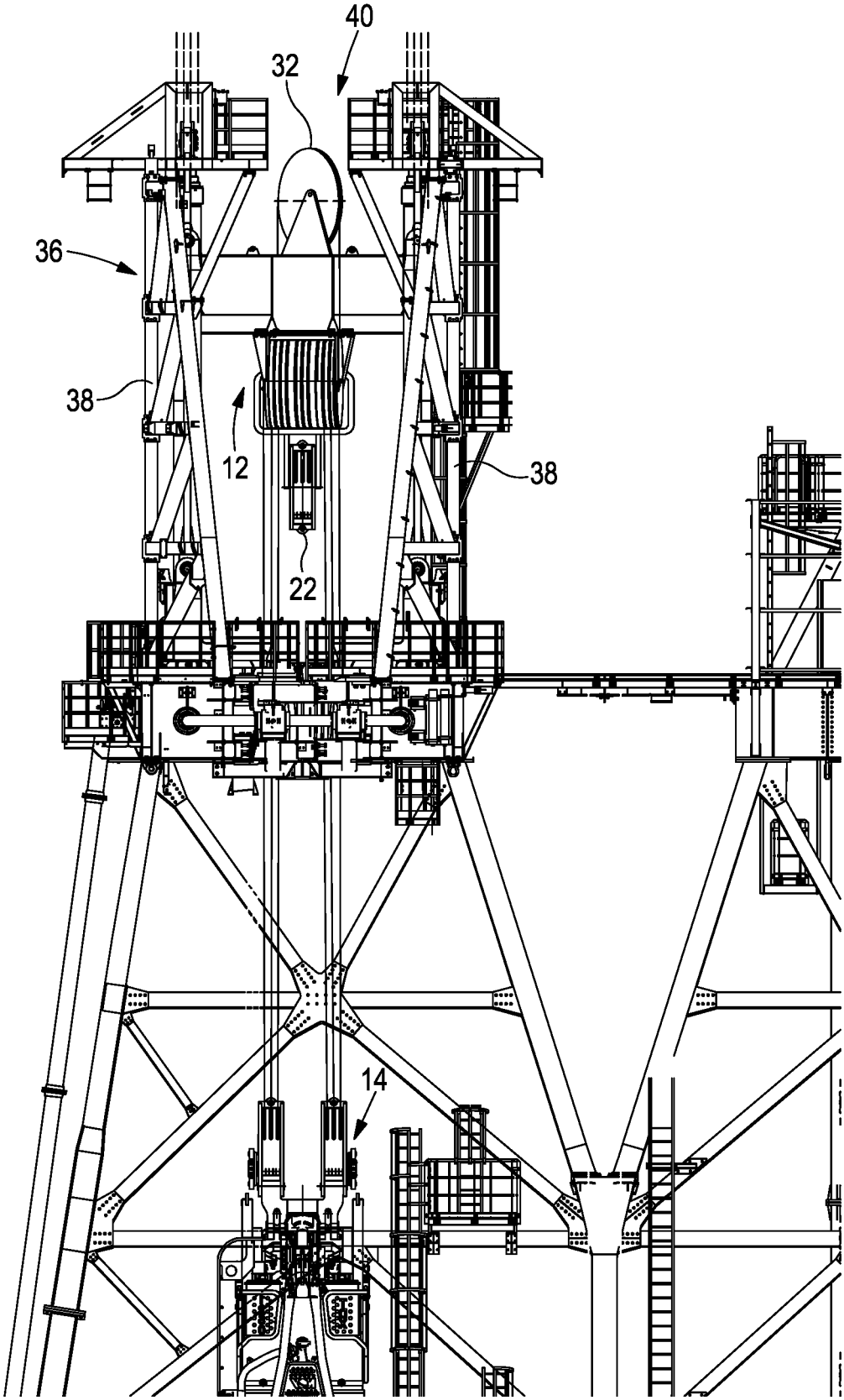
FIG. 15 is a side elevation view of the hoisting system of FIG. 14.

FIGS. 14 and 15 show an example hoisting system comprising a heave compensator for compensating for wave motion. The heave compensator comprises a crown compensator 36. The crown compensator 36 comprises a support frame comprising two masts 38 arranged to flank the crown block 12 and crossover sheave assembly. The masts 38 comprise tracks along which the crown block 12 and crossover assembly can be driven. The masts and tracks are arranged vertically such that the crown block and crossover sheave assembly can be raised and lowered. Raising and lowering the crown block to oppose the wave motion can minimise the movement of the payload with respect to the seabed.

In the present example, the crown compensator 36 provides passive heave compensation; although in other embodiments it may also/alternatively provide active heave compensation.

The masts 38 define a spacing thereinbetween 40 which will be discussed later.

When the crown compensator 36 is in a deactivated, or parked, state, as shown in FIG. 14, the crown block 12 is locked with respect to the support frame and is unable to move with respect to the rig/derrick on which it is installed. This may be the case when the hoisting system is in a heavy lift mode, at which time the winch may be configured to provide heave compensation by controlling the spooling of the hoisting cable. As the hoisting system is in a heavy lift mode, the travelling block of the system of FIG. 14 is in the second position—locked with respect to the travelling block (although it is to be noted that the activation state of the crown compensator is not directly linked to the arrangement of the travelling block).

FIG. 15 shows the same hoisting system, albeit with the crown compensator 36 activated. In this example, the winch is parked when the crown compensator is providing heave compensation. When the crown compensator 36 of the hoisting system of FIG. 15 is activated, the crown block and crossover sheave assembly are raised and lowered in response to wave motion. In FIG. 15, the crown block 12 and crossover sheave assembly are at a high position within the crown compensator 36, which is likely to correspond to the rig or derrick being located at the trough of a wave.

The opening 40 defined by the support frame is located directly above the crown block 12 and the crossover sheave 32. As such, the crossover sheave 32 can be received in the opening when the crown compensator moves the crown block 12 and crossover sheave assembly into a high position. This provides a more compact arrangement than may otherwise be the case.

The present invention has been described above purely by way of example. Modifications in detail may be made to the present invention within the scope of the claims as appended hereto.

The invention claimed is:

1. A hoisting system for a drilling rig, the hoisting system comprising:

a crown block for attaching to a derrick, the crown block comprising a plurality of sheaves;

a travelling block suspended from the crown block via a hoisting cable, the travelling block comprising a plurality of sheaves and being connectable with a payload, the travelling block being arranged to move along a workpath;

the hoisting system further comprising:

a floating block comprising a plurality of sheaves reeved on the hoisting cable;

wherein the floating block is configured to move between: a first arrangement in which the floating block is fixed relative to the crown block; and a second arrangement in which the floating block is fixed relative to the travelling block;

wherein the hoisting system is arranged such that, when the floating block is in one of the first or second arrangement, the sheaves of the floating block overlap a sheave of the crown block or travelling block in a direction of the work path, and wherein the plurality of sheaves of at least one of the crown block and the travelling block are axially separated into two sheave groups, and the floating block is arranged to be located at least partially between the two sheave groups when the floating block is in one of the first and second arrangements.

2. A hoisting system according to claim 1, wherein the floating block is arranged to overlap a sheave of the crown block or travelling block in such a way that it is nested or nestled amongst the sheaves of the crown block or the travelling block.

3. A hoisting system according to claim 1, wherein the floating block is arranged to overlap a sheave of the crown block or travelling block in such a way that it is nested or nestled amongst the sheaves of the crown block or the travelling block.

4. A hoisting system according to claim 1, wherein the hoisting system is arranged such that, when the floating block is in one of the first or second arrangement, the sheaves of the floating block totally overlap a sheave of the crown block or travelling block.

5. A hoisting system according to claim 1, wherein the plurality of sheaves of the floating block are axially separated into two sheave groups, and at least one sheave of the crown block or travelling block is arranged to be located at least partially between the two sheave groups when the floating block is in one of the first and second arrangements.

6. A hoisting system according to claim 1 wherein the hoisting system comprises a single attachment device for attaching a plurality of the sheaves of the floating block to at least one of the crown block and the travelling block.

7. A hoisting system according to claim 6, wherein the attachment device is arranged such that when the floating block is attached to the at least one of the crown block and the travelling block by means of the attachment device, the sheaves of the floating block totally overlap a sheave of the crown block or travelling block.

8. A hoisting system according to claim 1, wherein the hoisting system further comprises a winch engaged with the hoisting cable at a first end and comprising an anchor engaged with the hoisting cable at a second end.

9. A hoisting system according to claim 8, wherein the hoisting cable is reeved such that a portion of the hoisting cable reeved around a sheave of the floating block forms part of a deadline when the floating block is in one of the first and second arrangements.

10. A hoisting system according to claim 9, wherein the hoisting cable is reeved with a sheave of the floating block arranged closer than the sheaves of at least one of the crown block and the travelling block, to the anchor, such that the portion of the hoisting cable reeved around the sheave of the floating block forms part of the deadline when the floating block is in one of the first and second arrangements.

11. A hoisting system according to claim 1, further comprising a crossover sheave assembly, the crossover sheave assembly comprising at least one crossover sheave and being arranged such that the sheaves of the crown block, travelling block and/or floating block can be reeved onto the hoisting cable in an order which is different to the order in which they are attached to the respective block.

12. A hoisting system according to claim 11, wherein the crossover sheave is reeved on the hoisting cable between a first sheave of one of the crown block, travelling block or floating block and a second sheave of one of the crown block, travelling block or floating block; wherein the crossover sheave is arranged perpendicularly or obliquely to the first and second sheave.

13. A hoisting system according to claim 1, wherein the travelling block comprises the floating block and the floating block forms a detachable module of the travelling block, such that the floating block is suspended from the crown block via the hoisting cable.

14. A hoisting system according to claim 13, wherein the plurality of sheaves of the travelling block are axially separated into two sheave groups, and the floating block is attachable to the travelling block between the two sheave groups, with the sheaves of the floating block substantially axially aligned with the sheaves of the travelling block when the floating block is in the second arrangement.

15. A hoisting system according to claim 13, comprising:

a winch engaged with the hoisting cable at a first end;

an anchor engaged with the hoisting cable at a second end; and a crossover sheave arrangement;

wherein the crossover sheave arrangement comprises a crossover sheave and is arranged such that a sheave of the floating block is arranged on the hoisting cable at a location closer than a sheave of the travelling block, to the anchor.

16. A hoisting system according to claim 13, wherein the travelling block comprises an even number of sheaves separated into two axially separated sheave groups of equal number, and the floating block comprises an attachment device and is arranged to be attached to the travelling block between the two sheave groups such that the sheaves of the floating block totally overlap the sheaves of the travelling block.

17. A hoisting system according to claim 1, wherein the hoisting system is arranged to provide two lifting ratios, a first lifting ratio when the floating block is fixed relative to the crown block, and a second lifting ratio when the floating block is fixed relative to the travelling block.

18. A hoisting system according to claim 1, further comprising a heave compensator configured to compensate for motion.

19. A hoisting system according to claim 18, wherein the heave compensator is associated with a winch of the hoisting system which is configured to provide heave compensation by controlling the spooling rate to compensate for motion.

20. A hoisting system according to claim 18, wherein the heave compensator comprises a crown compensator arranged to facilitate movement of the crown block to compensate for motion wherein the crown compensator comprises a supporting frame which defines an opening for receiving at least part of the crown block or a crossover sheave when the crown block is at its uppermost position in the crown compensator.

21. A method for changing the lifting ratio of a hoisting system according to claim 1, the method comprising:

moving a floating block comprising a plurality of sheaves between a first arrangement, in which it is fixed relative to a crown block, and a second arrangement, in which it is fixed relative to the travelling block.

* * * * *